US007338005B2

(12) United States Patent
Biagiotti et al.

(10) Patent No.: US 7,338,005 B2
(45) Date of Patent: Mar. 4, 2008

(54) REWINDER MACHINE FOR THE PRODUCTION OF ROLLS OF WEB MATERIAL

(75) Inventors: Guglielmo Biagiotti, Capannori (IT); Raffaello Bonacchi, Lucca (IT); Angelo Benvenuti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 245 days.

(21) Appl. No.: 10/537,431

(22) PCT Filed: Nov. 27, 2003

(86) PCT No.: PCT/IT03/00785

§ 371 (c)(1),
(2), (4) Date: Jun. 21, 2005

(87) PCT Pub. No.: WO2004/050520

PCT Pub. Date: Jun. 17, 2004

(65) Prior Publication Data

US 2006/0076451 A1 Apr. 13, 2006

(30) Foreign Application Priority Data

Dec. 3, 2002 (IT) ..... FI2002A0236
May 30, 2003 (IT) ..... FI2003A0157

(51) Int. Cl.
*B65H 67/04* (2006.01)

(52) U.S. Cl. ..... 242/533.3; 242/532.3

(58) Field of Classification Search ..... 242/526, 242/526.1, 532, 532.3, 533, 533.2, 533.3, 242/527.2, 527.3, 542, 542.1, 542.2
See application file for complete search history.

(56) References Cited

U.S. PATENT DOCUMENTS

| | | | | |
|---|---|---|---|---|
| 4,327,877 | A | 5/1982 | Perini | |
| 4,487,377 | A | 12/1984 | Perini | |
| 5,772,149 | A | 6/1998 | Butterworth | |
| 6,050,519 | A * | 4/2000 | Biagiotti | 242/526.1 |
| 6,422,501 | B1 | 7/2002 | Hertel et al. | |

FOREIGN PATENT DOCUMENTS

| | | |
|---|---|---|
| EP | 0 395 593 A2 | 10/1990 |
| EP | 0 395 593 A3 | 10/1990 |
| EP | 0 524 158 A1 | 1/1993 |
| FR | 2 544 701 A1 | 10/1984 |
| WO | WO 94/21545 A1 | 9/1994 |
| WO | WO 97/32804 A1 | 9/1997 |

* cited by examiner

*Primary Examiner*—Peter M. Cuomo
*Assistant Examiner*—William E Dondero
(74) *Attorney, Agent, or Firm*—Breiner & Breiner, LLC

(57) ABSTRACT

The rewinder machine comprises: a first winding roller (3); a second winding roller (5), defining with said first winding roller (3) a winding cradle; a feeder (33) for sequentially introducing winding cores to said winding cradle; an optional glue applicator (21) for applying glue to said cores. The feeder (33) may include an element (39) for applying glue to the winding cores while they are being fed to said winding cradle. In a special embodiment, the feeder is mechanically linked to a system for unloading the roll from the winding cradle.

38 Claims, 13 Drawing Sheets

REWINDER MACHINE FOR THE PRODUCTION OF ROLLS OF WEB MATERIAL

TECHNICAL FIELD

This invention relates to a rewinder machine and, more in particular, a so-called peripheral rewinder machine, i.e. one in which the rotary motion of the roll in the formation phase is provided by mobile mechanical members in contact with the external surface of the roll.

More precisely, this invention relates to a rewinder machine of the type including at least two winding rollers which in combination define a winding cradle, optional means of gluing the winding cores or spindles (or other alternative members for initiating the winding around the new winding core) and means of introducing the winding cores into the winding cradle.

The invention also concerns a winding method for the production of rolls of web material wound around winding cores or spindles.

The invention can be implemented both on machines destined for production of rolls where the winding core remains inside, and those for rolls where the winding core is extracted after winding is completed.

STATE OF THE ART

For the production of rolls of web material, especially rolls of toilet-paper, kitchen towels, and rolls of so-called "tissue" paper in general, starting from large diameter bobbins, machines known as rewinders are used, which wind predetermined lengths of web material around cores made of cardboard or another suitable material. The formed rolls have a diameter equal to that of the finished product and an axial length that is normally greater that of the rolls destined for sale. These rolls, also known as logs, are subsequently cut orthogonally to their axis to obtain the final product destined for distribution and consumption.

The rewinder machines currently in widest use are of the so-called peripheral type, i.e. in which the roll is formed by keeping it in contact with mobile members, typically two or three rotating rollers. Friction between the winding rollers and the roll being formed keep the latter in rotation around its own axis to wind the desired quantity of web material around the winding core.

An example of this type of rewinder machine is described in U.S. Pat. No. 4,327,877 This known rewinder includes three winding rollers, between which the roll of web material wound around a winding core is formed. The core and the web material are made to pass through a nip defined between a first and a second winding roller. The third winding roller has a mobile axis that permits the diameter of the roll being formed to grow. A feeder member picks up single winding cores and inserts them into the nip between the first and the second winding rollers, towards the winding cradle defined by the three winding rollers. When winding of the roll is completed, it is removed from the winding cradle via a rolling surface that is moved towards the roll, and on which the roll is made to roll down. Blasts of air generate a loop of web material that inserts itself between the new winding core and the lower winding roller, causing the web material to tear and starting the winding of the next roll.

In U.S. Pat. No. 4,487,377 a peripheral rewinder machine is described, in which at the end of the winding of each roll the web material is interrupted by the cutting action of a blade located upstream of the insertion nip between the first and the second winding rollers. The winding cores are inserted in the nip between the first and the second winding rollers, towards the winding cradle, via a feeder oscillating around an axis substantially parallel to the, axis of rotation of the winding rollers. The cores are fed to the feeder via a chain conveyor that unloads one winding core at a time inside a hopper, from where it is picked up by an oscillating movement of said feeder.

In EP-A-0 524 158 a peripheral rewinder machine is described in which the winding cores are picked up and inserted in the nip between the winding rollers by an oscillating feeder. The web material is tom at the end of winding by a rapid acceleration of the third winding roller in advance of the instant of introduction of the winding core in the nip between the first and the second winding rollers. The breakage of the web material occurs due to the tension on the material itself and its pinching between the main winding roller and the new winding core that is inserted in the winding zone.

In WO-A-94/21545 a peripheral rewinder machine is described that includes a cluster of three winding rollers defining a winding cradle. A rolling surface extends upstream of the winding cradle, which surface defines along with the first winding roller a channel for the insertion of the winding cores. Along this channel, in an intermediate position between the finished roll and the new winding core, a separator member operates, which interrupts the web material at the end of winding a roll and before starting winding of the next roll.

These rewinder machines run in automatic work cycles at high speed and have complex mechanisms, synchronized with each other, to carry out the interruption of the web material, the discharge of the finished roll and the insertion of the winding core. Systems for applying glue to start winding around a new winding core are also provided. They are therefore very complex and expensive and require large investments, in addition to careful setting up.

In WO-A-97/32804 a peripheral rewinder machine with a special structure is described, having the object of reducing the machine's dimensions and allowing it to be transported, practically without disassembly, inside a single container. This rewinder machine is destined, in particular, to meet the requirements of emerging markets, where it is not possible to make large investments for the purchase of a complex and cumbersome production line. Nevertheless, it continues to be excessively sophisticated and therefore expensive for certain markets, where the consumption of tissue paper, toilet paper and similar products is still limited and insufficient to justify large investments in production plant.

OBJECTS AND SUMMARY OF THE INVENTION

In accordance with a first aspect, the object of this invention is to provide a rewinder machine, and in particular, a so-called peripheral rewinder machine, that has even lower costs, small dimensions and extreme constructional simplicity combined with high reliability. In particular, the object of the invention is to provide a machine in which there is limited use of both electronic components and of motors that require reciprocal phasing.

The object of the invention is also to provide a rewinder machine that, thanks to its simplicity, has low maintenance costs and reduces the need for interventions by specialized personnel.

The object of the invention is also to provide a new production method for rolls of web material wound around winding cores.

In accordance with a first-aspect, these and further objects and advantages, which will be clear to those skilled in the art from reading the text that follows, are essentially achieved with a rewinder machine comprising, in combination: a first winding roller; a second winding roller, defining with said first winding roller a winding cradle; a feeder for sequentially introducing winding cores towards said winding cradle; and a gluer for applying glue to said cores. Characteristically, in accordance with the invention, the feeder includes at least one element for applying glue to the winding cores during their introduction into the winding cradle. In this way, the machine becomes substantially simplified, because with a single mechanical member, which can also be manually operated, it is possible to perform the picking up and introduction of the individual winding cores into the machine and apply glue to them, necessary for initiating the winding of the web material around the cores themselves.

In accordance with a possible and advantageous embodiment of the invention, the feeder has at least one elongated member that is immersed in a container of glue arranged below the pick up zone for the winding cores. The elongated member, for example a wire or a cable, becomes covered in glue when it is immersed in the container and will consequently transfer at least part of the glue by contact to each core that is sequentially picked by said feeder and inserted towards the winding cradle. The feeder can have, in accordance with a possible variant of embodiment, two wires or other equivalent elongated members, roughly parallel with each other, for applying two-stripes of glue on each winding core. This enables a more stable and reliable anchorage to be achieved for the initial free edge of the web material on the respective winding core.

The feeder can also be provided with an insertion movement, such as a translation for example. Nevertheless, in accordance with a preferred embodiment of the invention, the feeder oscillates around an axis substantially parallel to the axis of the winding rollers. In practice, the feeder can include two mobile arms, oscillating for example, connected to each other and to which the ends of the wire(s) or other elongated members that pick up the glue from the container are constrained. The wire(s) are thus held under tension between the two arms of the feeder.

The arms can be arranged laterally on the outside of the glue container, and have the upper ends bent like an inverted U, on which the glue collecting wire(s) are constrained. In this way, the wires can be immersed in the glue held inside the container while keeping the oscillating arms (except for the free end of each arm) outside of the container itself.

In accordance with a perfected embodiment of the invention, an extractor member can be mechanically linked to the feeder, for extracting a completed roll from said winding cradle. This solution is particularly advantageous as it allows the roll to be extracted from the winding cradle via a single operation of contextually operating the feeder and the extractor member. In practice, the extractor member can be arranged so that it is hinged around the axis of rotation of the second winding roller and, in addition, is connected to the feeder via a pair of tie rods. In this case, the extractor member has a picking surface for the rolls to be unloaded from the winding cradle. This surface is shaped such that it is tangential to the second winding roller when it is moved alongside the winding cradle to extract and unload the finished roll. The pick up surface can be part of a channel or cradle in which the roll is received and then unloaded with an oscillating movement of the channel itself, or can be constituted by a rolling surface, on which the finished roll is made to roll, under the effect of gravity for example.

The feeder—and in consequence the extractor member for the finished roll, when it is constrained to the feeder—can be controlled by an operator, via a pedal control for example. The operator operates the pedal when the desired amount of web material has been wound around the roll being made. Alternatively, with a modest increase in machine complexity, the operation of the feeder and the members connected to it can be achieved via a mechanical control driven by the machine's main motor or by a pneumatic cylinder.

To facilitate insertion of the winding cores through the nip between the first and the second winding rollers towards the winding cradle, it can be advantageously foreseen, in a manner known per se, that the first and the second winding rollers be controlled to assume, during at least part of the winding cycle of each roll, mutually different peripheral speeds to facilitate the introduction of the winding core through said nip. For example, the second winding roller could be temporarily slowed down. This slowing can also be achieved with a manual intervention by the operator. For example, a band brake could be provided that is operated by the same pedal used by the operator to operate the feeder for the new winding core and the extractor member for the finished roll. Alternatively, a device could be provided on the transmission of the drive to the roller that opportunely and temporarily changes the transmission ratio.

A gluing device for closing the free end edge of the roll can be arranged in the zone for unloading the finished roll from the winding cradle. This device can be entirely manually operated, or can be partially mechanized.

In accordance with a different aspect of this invention, a rewinder machine is provided for the production of rolls of web material wound around winding cores, comprising: a first winding roller; a second winding roller, defining with said first winding roller a winding cradle; a feeder for sequentially introducing winding cores to said winding cradle. Characteristically, in accordance with the invention, an extractor member for extracting a finished roll from said winding cradle is mechanically linked to the feeder.

In accordance with another aspect, the invention also concerns a method for producing rolls of web material wound around winding cores in which: a first roll is completed in a winding cradle; when winding of said first roll is completed, a new winding core is inserted via a feeder to the winding cradle and the first roll is unloaded from the winding cradle, glue being applied to said winding core. Characteristically, in accordance with the invention, the glue is applied on the new winding core via said feeder.

In accordance with another aspect, the invention contemplates a machine with a special and low-cost control system for the introduction of new cores and the unloading of finished rolls. This system can be embodied with or without using glue for starting the winding. In accordance with this aspect, the invention concerns a rewinder machine for the production of rolls of web material wound around winding cores, comprising:

- a first winding roller
- a second winding roller, defining with said first winding roller a winding cradle
- a feeder for sequentially introducing winding cores to said winding cradle; characterized in that an extractor member for extracting a finished roll from said winding cradle is mechanically linked to said feeder. In this case, application of the glue can be provided and embodied as described above, or using a different system, although the application of glue can also be eliminated and other systems used for anchoring the free end of the web material to the new winding core.

Additional and secondary characteristics can be shared and combined in a variety of ways in machines with this invention's innovative gluing system and/or the mechanical linkage system of the feeder to the unloading device for finished rolls.

Further advantageous characteristics and forms of embodiment of the method and the machine in accordance with the invention are indicated in the enclosed dependent claims.

BRIEF DESCRIPTION OF DRAWINGS

The invention will be better understood following the description and attached drawings, which show ractical, non-limitative embodiments of the invention. More in detail, these show.

DETAILED DESCRIPTION OF THE PREFERRED FORMS OF EMBODIMENT OF THE INVENTION

Figure 1:
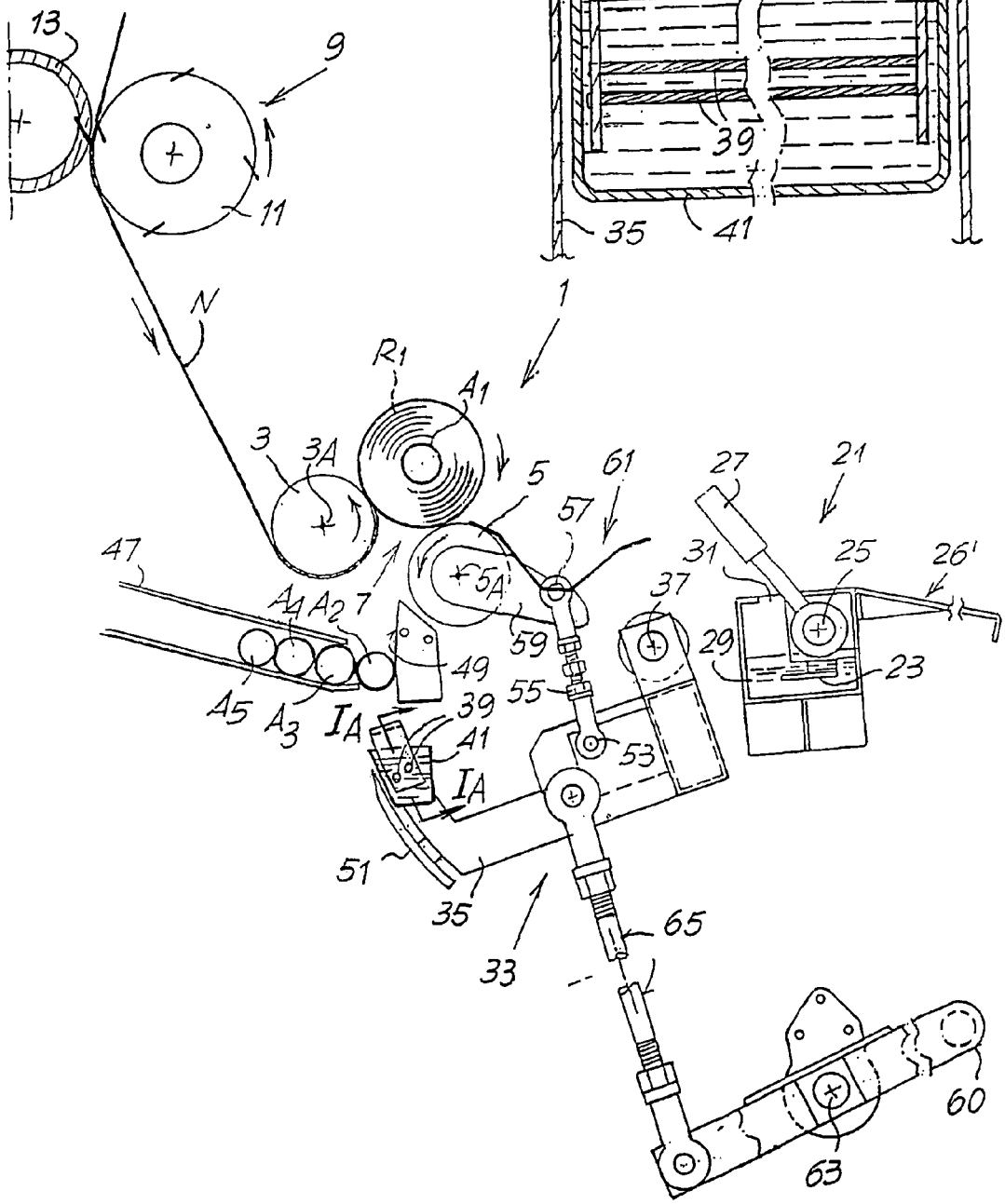
FIG. 1 a schematic side view of a machine in accordance with the invention in a first embodiment, FIG. 1A an enlarged detail along IA-IA in FIG. 1, FIGS. 2 to 6 successive operational phases of the machine in FIG. 1, with the same side view, FIGS. 7 to 12 successive operational phases of a rewinder machine in accordance with the invention in a modified embodiment, FIG. 13 another embodiment of the machine in accordance with the invention.

With initial reference to FIGS. 1 to 6, in this embodiment, the rewinder, generally designated by reference 1, includes a first winding roller 3 and a second winding roller 5, arranged with their axes of rotation 3A and 5A parallel to each other. A nip 7 is defined between the winding rollers 3 and 5, through which the web material to be wound is fed, indicated by N. The web material N is wound, in the condition shown in FIG. 1, around a first winding core indicated by A1, the diameter of which is advantageously slightly larger than the minimum size of the nip defined between the two winding rollers 3 and 5, through which the core passes thanks to its capacity of deformation when squeezed.

The rotary movement imparted to the roll being formed, indicated by R1, is provided by the winding rollers 3 and 5. A perforator group, generally designated by reference 9, is situated along the path of the web material and includes a first rotating cylinder 11 equipped with a perforation blade cooperating with a fixed blade carried on a beam 13. The perforator group creates perforation lines on the web material N, which delimit sections or sheets of web material that can be torn off by the end user.

A gluing device, generally designated by reference 21, for applying the glue necessary for closing the free end edge of the roll formed by the rewinder machine is positioned downstream of the pair of winding rollers 3 and 5, i.e. on the opposite side of the zone from where the web material N to be wound arrives. The gluing device 21 has a mobile distribution element, indicated by 23, turning around an axis 25 parallel to the axis of the winding rollers 3 and 5. Rotation of the element 23 is manually controlled by a lever 27 operated by the operator of the machine. Glue for closing the finished roll is contained in a tank or container 29 that has an upper opening 31, elongated orthogonally to the plane of the figure and with a width such that the finished roll can remain stably resting on the edges of the slit or opening 31. This enables the gluing of the finished roll to be easily carried out, in the manner described in the following. The width of the aperture 31 can also be adjustable, for example, according to the size of the diameter of the rolls to be produced.

To sequentially insert the winding cores into the winding zone defined by the cradle formed by the winding rollers 3 and 5, a feeder is provided, generally designated by reference 33, comprising a pair of oscillating arms 35 hinged around an axis 37 parallel to the axis of the winding rollers 3 and 5. As shown in the enlarged detail in FIG. 1A, the upper ends of the oscillating arms 35 are bent in an inverted U shape and two wires or cables 39 (or other elongated members with equivalent functionality, such as rods, bars, or similar) are anchored by their ends to said upper ends, such that they are under tension and oriented in a direction parallel to the axes of the rollers 3 and 5. The two oscillating arms 35 are arranged laterally at the side of a container or tank of glue 41, which contains the glue to be applied to the winding cores on which the rolls of web material are formed. This glue serves to make the initial edge of each roll adhere to the individual cores. In the position illustrated in FIG. 1, the oscillating arms 35 are in their lower position, with the free ends immersed in the tank 41, so that the wires 39 are also immersed in the glue contained in the tank.

Figure 1A:
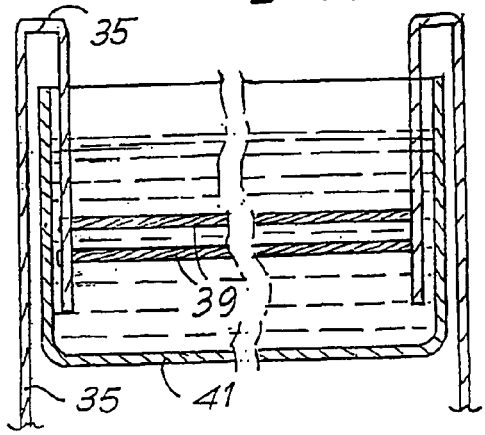
Figure 2:
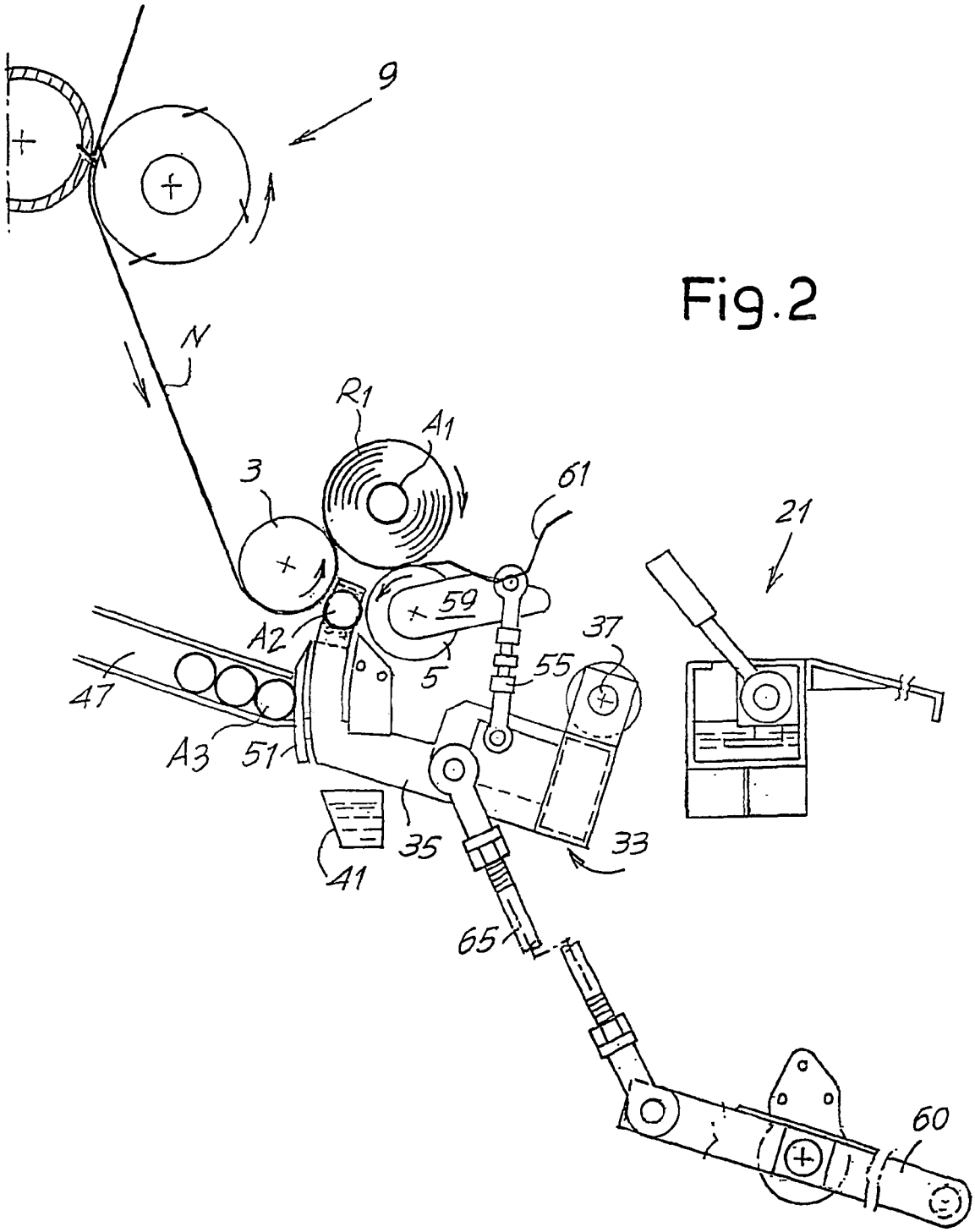

A channel 47 is formed in the zone between the position assumed by the pair of oscillating arms 35 of the feeder 33 illustrated in FIG. 1 and the pair of winding rollers 3 and 5, in which the winding cores destined to be sequentially introduced to the winding cradle are arranged. The channel 47 terminates in a core-picking zone, from where these are individually picked and transferred to the winding rollers 3 and 5. In FIG. 1 there are four cores, indicated by A2, A3, A4 and A5, waiting in the channel 47. A fixed section 49 holds back the first core of the queue of waiting cores. The space between section 49 and the border of the channel 47 is sufficient for the wires 39 carried by the two oscillating arms 35 to pass, but not enough to let the core A2 fall through, which thus remains in the waiting position.

A shaped plate 51 or a series of teeth are integral with the oscillating arms 35 for the purpose, as will be described in the following, of retaining all of the cores in the channel 47 except for the first core of the queue during the introduction movement of the first core on the queue into the nip defined by the winding rollers 3 and 5.

On the oscillating arms 35, respective tie rods 55 are hinged at 53, with their other ends each hinged at 57 on a corresponding support 59 oscillating around the axis 5A of winding roller 5. The pair of supports 59 have an integral cradle or chute 61 formed by a V-shaped section; with two sides that define the support surfaces for the finished roll, which must be unloaded from the winding cradle formed by the rollers 3 and 5.

The oscillating movement of the arms 35 of the feeder 33, and in consequence of the supports 59 constrained by the arms 35 via the tie rods 55, is controlled by an operator using a pedal 60 hinged around an axis 63 and constrained via tie rods 65 to the oscillating arms 35.

Figure 3:
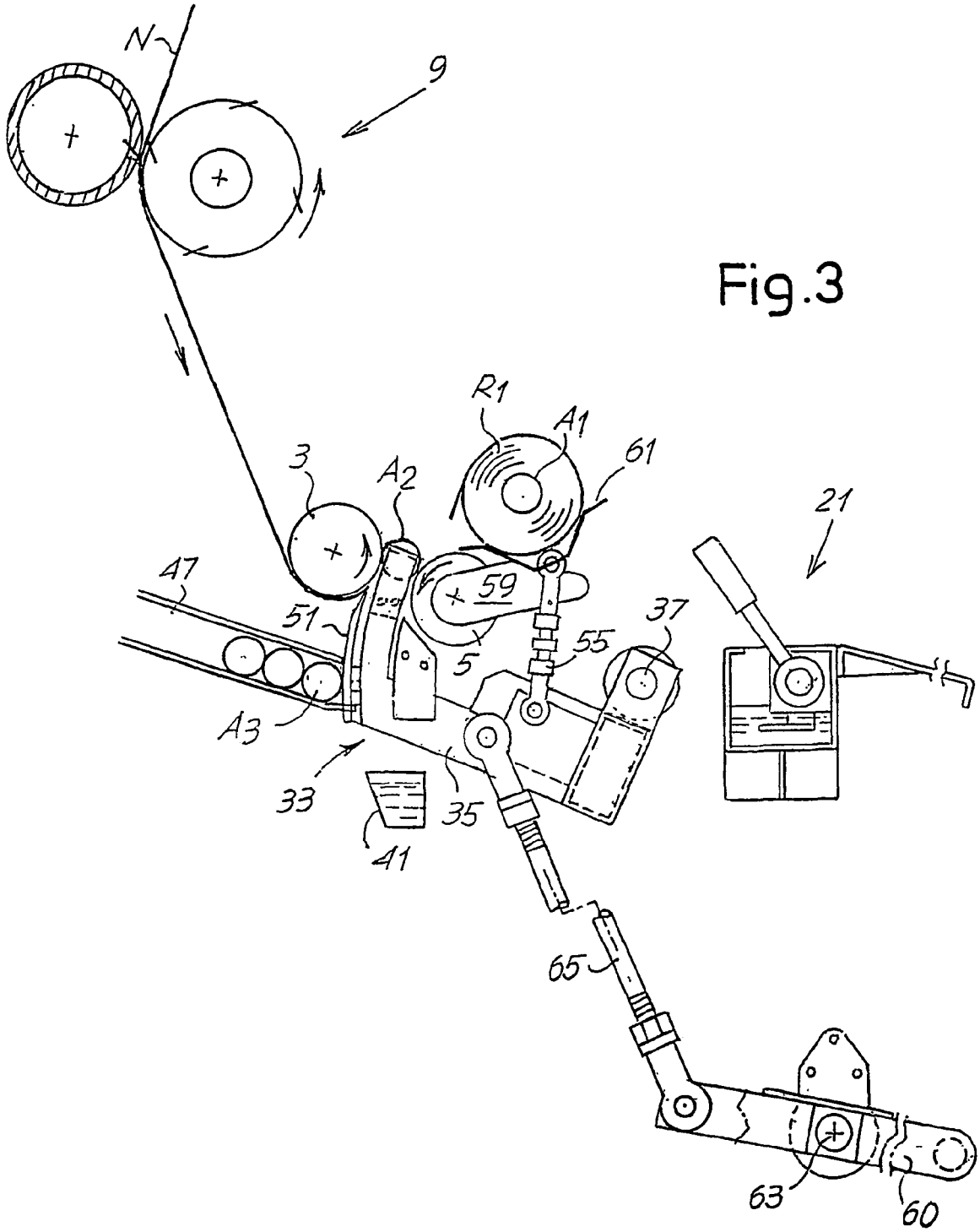

The machine described up to here operates as follows. When the roll R1 being made in the cradle between the rollers 3 and 5 reaches the desired size, determined by the operator or, for example, by a counter that detects the length of the wound web material N or the number of perforations performed on the web material by the perforator group 9, the operator uses the pedal 60 to control the raising of the feeder 33. During a first segment of travel of the pedal 60, which moves from the position in FIG. 1 to the position in FIG. 2, the oscillating arms 35 pick up the core A2 waiting at the outlet of the channel 47 and lift it towards the nip defined by the winding rollers 3 and 5. Contact of the core A2 with the wires 39 covered in glue carried by the oscillating arms 35 causes not just the lifting of the core, but also the application of two lines of glue on its surface. The shaped section 51 that is integrally raised with the arms 35 holds back the other cores A3, A4 and A5 inside the channel 47 while the core A2 is inserted into the nip between the winding rollers 3 and 5. Using a clutch control, or a brake or other known suitable means (optionally controlled by the same pedal 60) a deceleration of the winding roller 5 is also produced. This facilitates insertion of the winding core A2 through the nip 7, when the core itself makes contact with the cylindrical surfaces of the two winding rollers 3 and 5. This contact occurs by lifting the oscillating arms 35 further upwards with respect to the position shown in FIG. 2. This additional oscillating movement is caused by the operator depressing the pedal 60 even more. The additional depression of the pedal 60 follows the insertion of the core inside the nip 7 and causes a further oscillation of the supports 59 hinged around the axis 5A and consequently of the chute 61 that is integral with the supports. The left side (in the figures) of the chute 61 thus inserts itself (see FIG. 3) between the winding roller 5 and the finished roll R1. The roll, because of its inertia due to the rotary motion it possesses, jumps inside the chute 61 as shown in FIG. 3. In this way, the roll halts and the web material slackens. In the meantime, the winding core A2 that has made contact with the winding rollers 3 and 5 starts to roll forwards through the nip 7 due to the different peripheral speeds of the two rollers. The glue applied by the wires 39 on the cylindrical surface of the winding core A2 causes adhesion of the web material N that has become slack, as described above. Thus, the material enters and remains glued to the core, between the latter and the second winding roller 5. This provokes the tearing of the material along a line of perforation. Alternatively, the tear could be made with a manual operation by the operator. The tear generates a free initial edge of a new roll, which starts to form itself around the second winding core A2, as well as the final edge of the finished roll R1, which will be made to adhere to the roll in the manner described further on.

Figure 4:
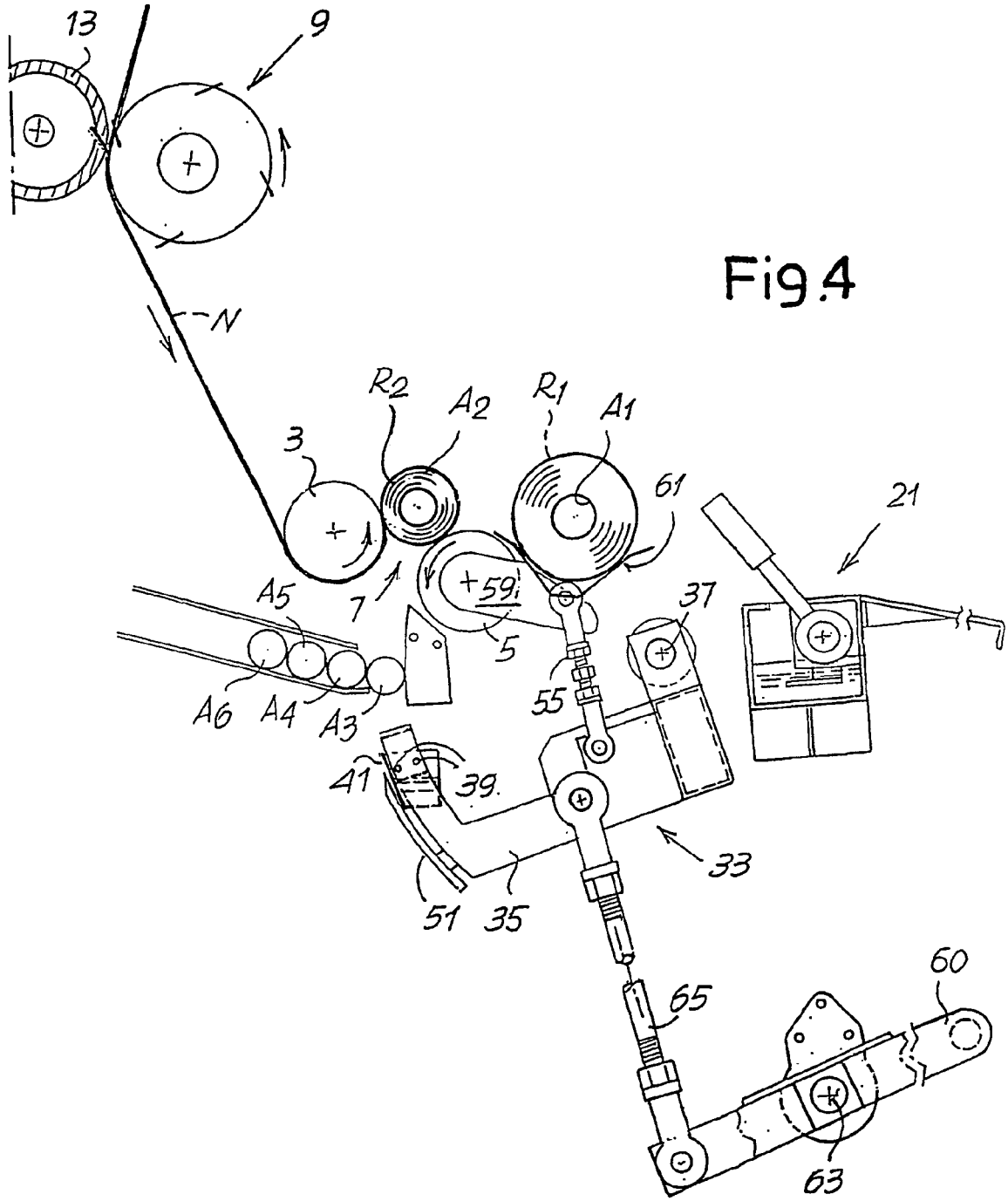
Figure 5:
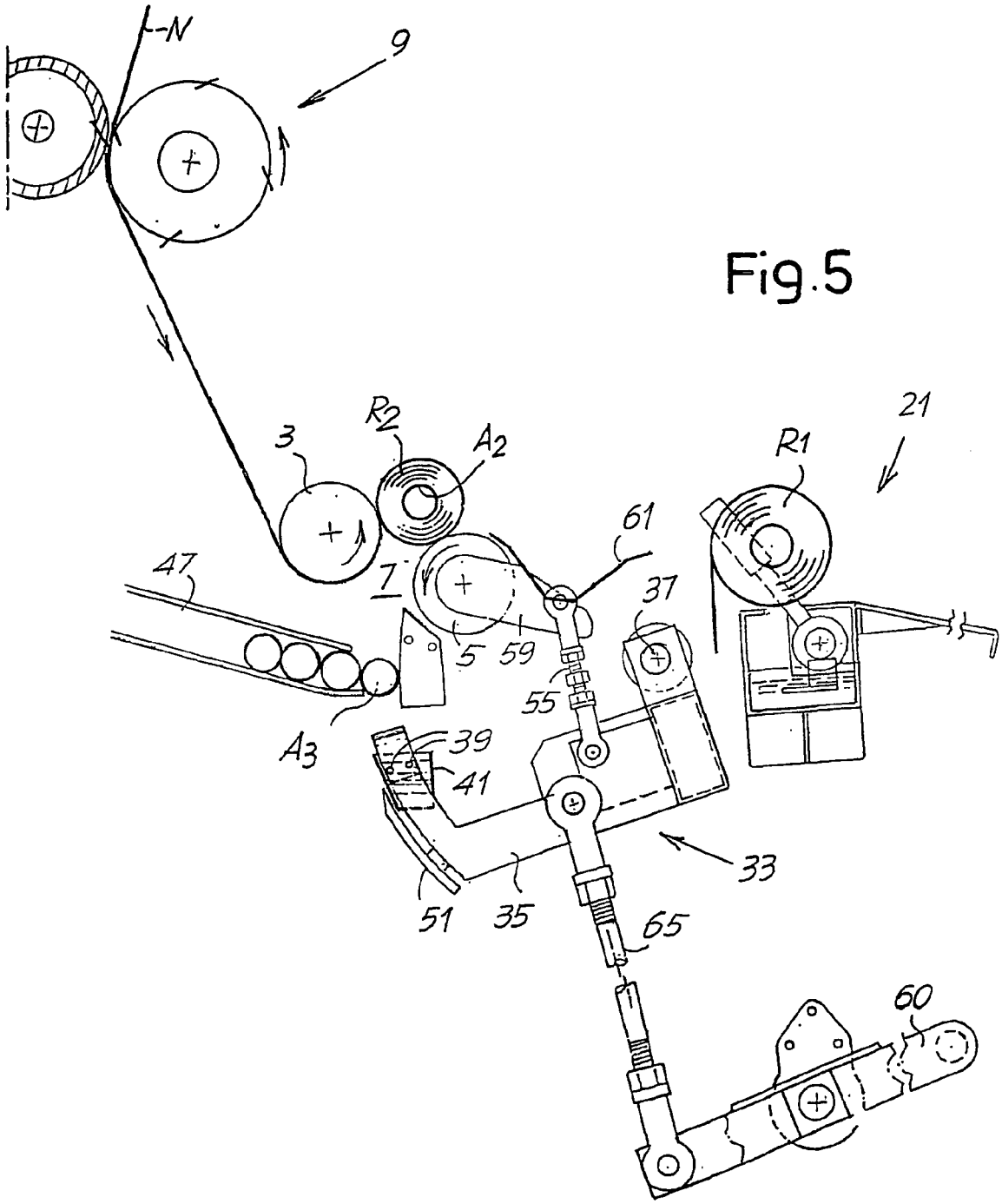
Figure 6:
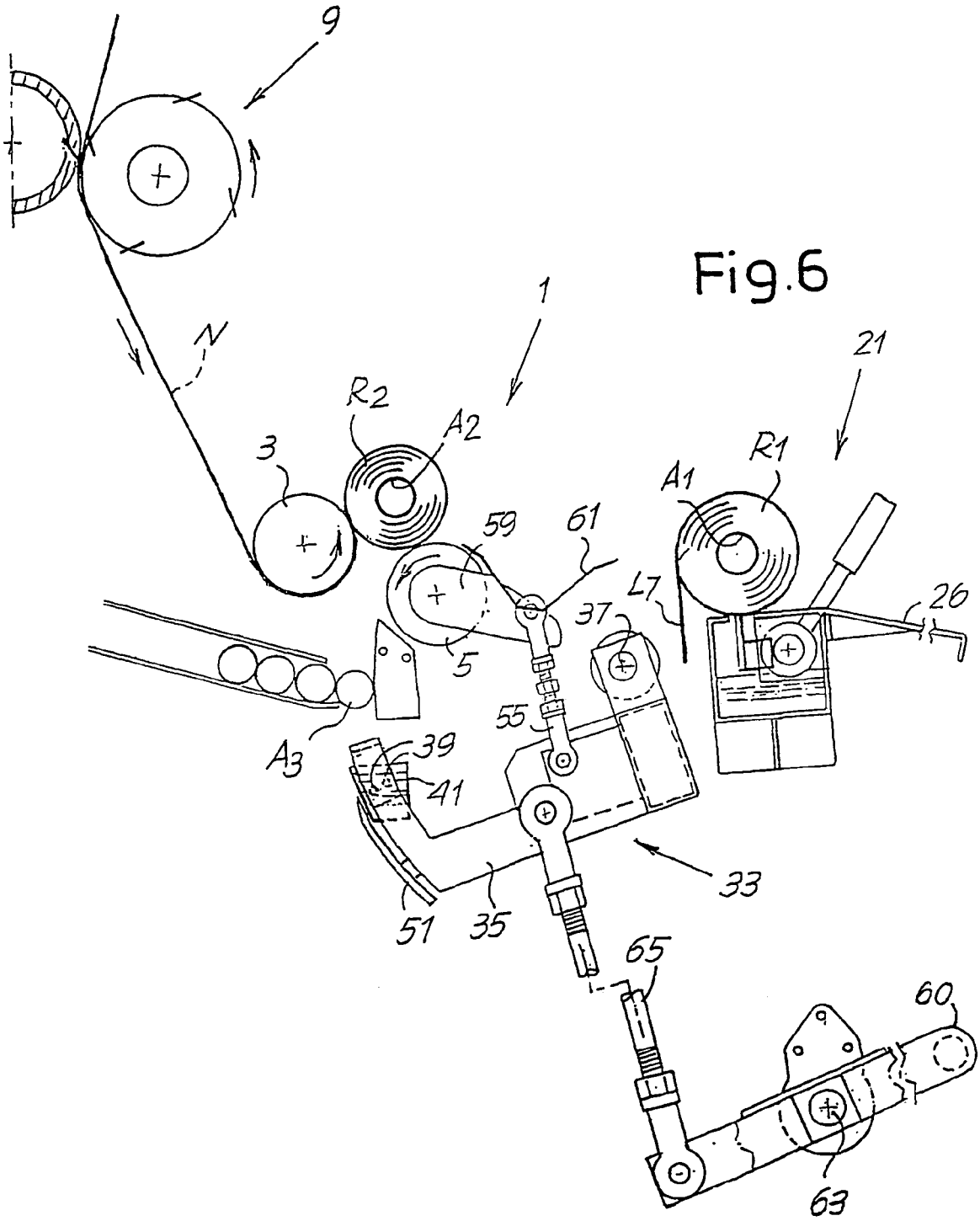

Once the finished roll R1 is in the chute 61 and the new winding core A2 has been inserted into the nip 7 between the winding rollers 3 and 5, the operator can release the pedal 60, so that the various members assume the positions in FIG. 4. The set-up shown in FIG. 4 corresponds to that of FIG. 1, except for the fact that the new roll being formed in the winding cradle 3 and 5 (indicated by R2) is in its initial winding phase and therefore has a smaller diameter, while previously wound roll R1 is still in the chute 61. From here, the operator manually picks the roll and, after having unrolled and positioned the end edge as shown in FIG. 5, rests it on the opening 31 of the container 29, which contains the glue provided for closing the free edge of the finished roll. As previously mentioned, the transversal size of the opening 31 is such that the roll resting on it is in stable equilibrium. The operator operates the lever 27 to bring the mobile element 23 into contact with the surface of the finished roll R1, in an angular position on which the previously unrolled free end edge Lf will again be laid. At this point, closure of the roll is performed by making the roll R1 roll on the surface 26 that is downstream of the opening 31 of the container 29.

Figure 7:
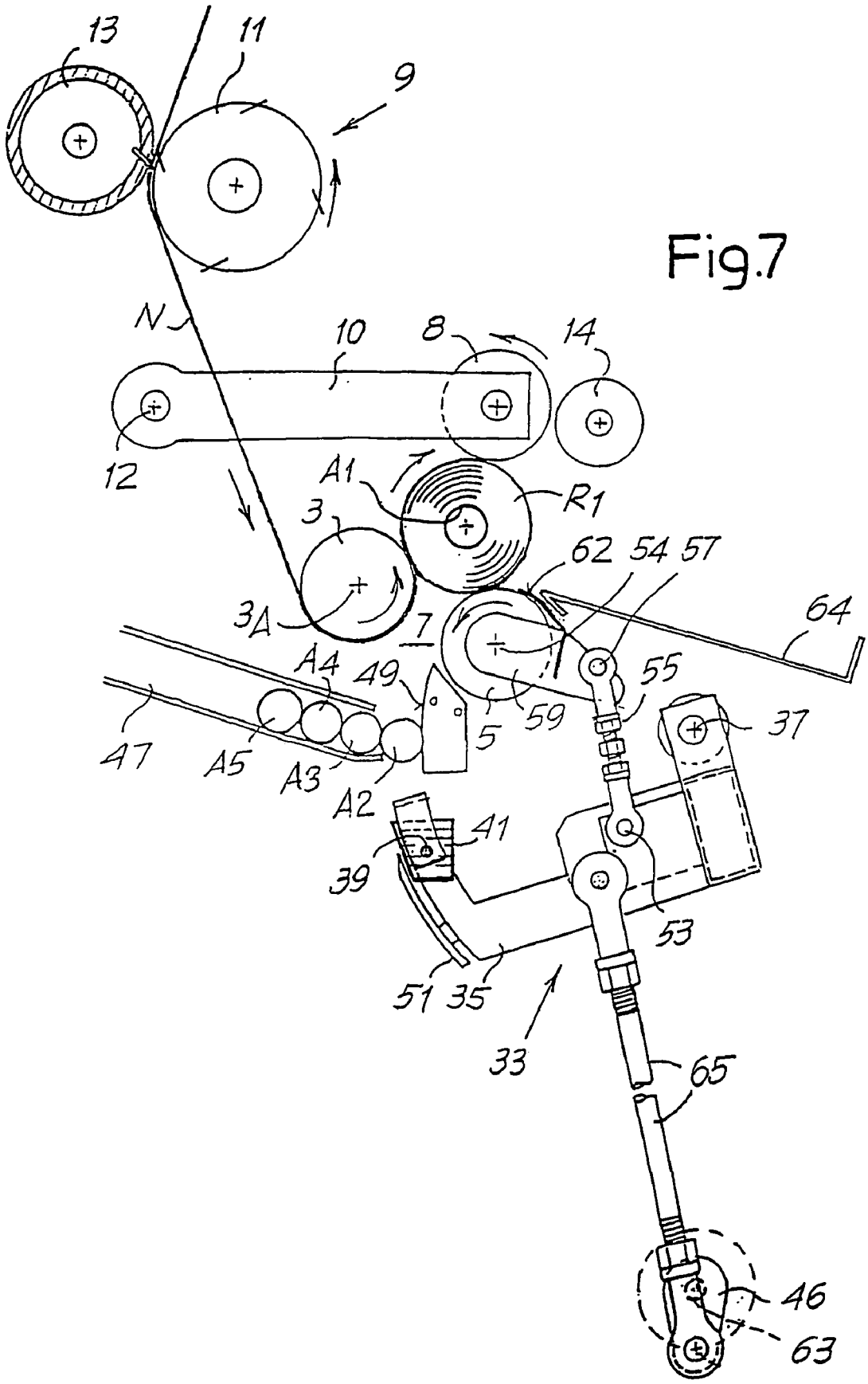
Figure 8:
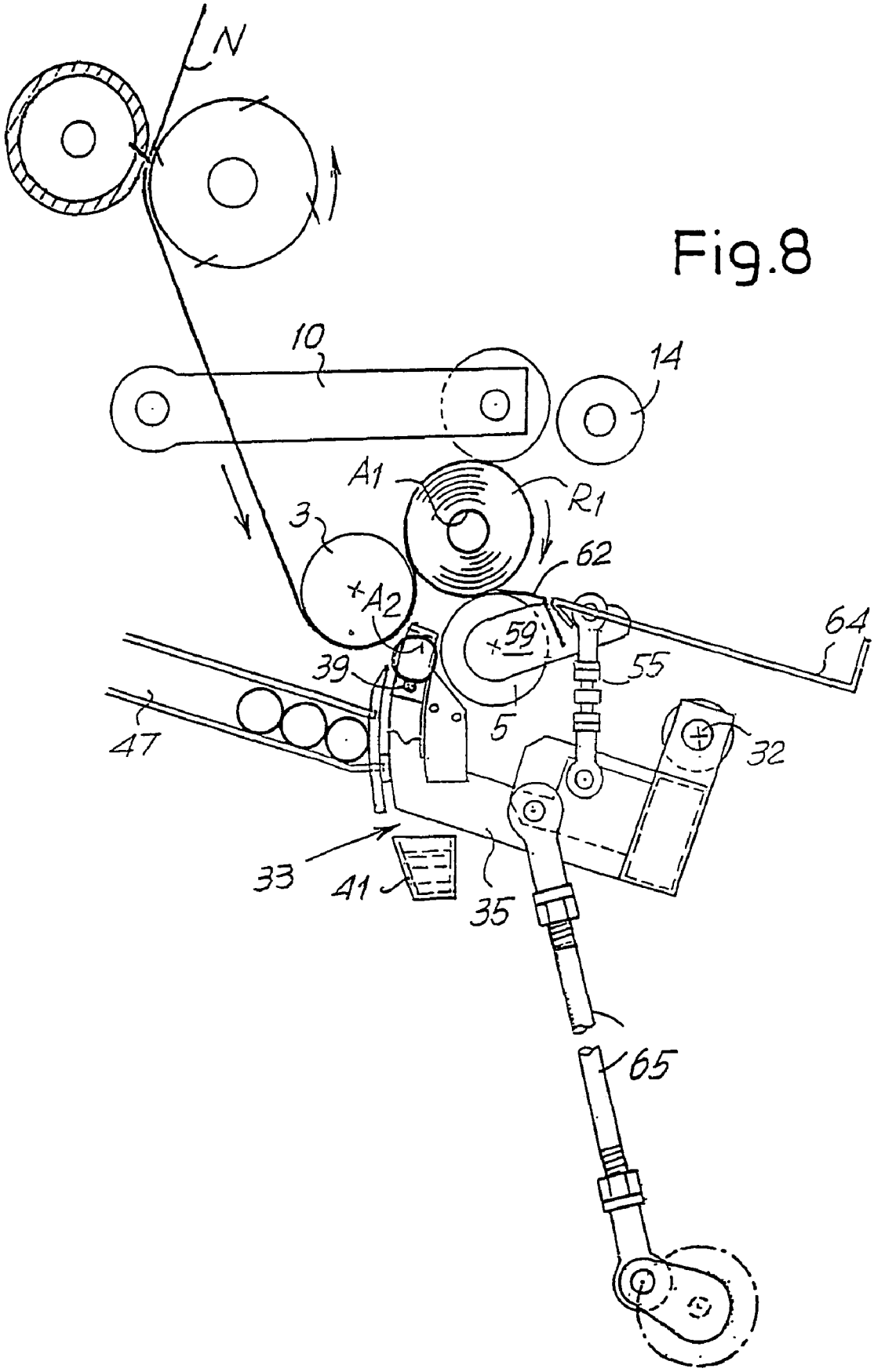
Figure 9:
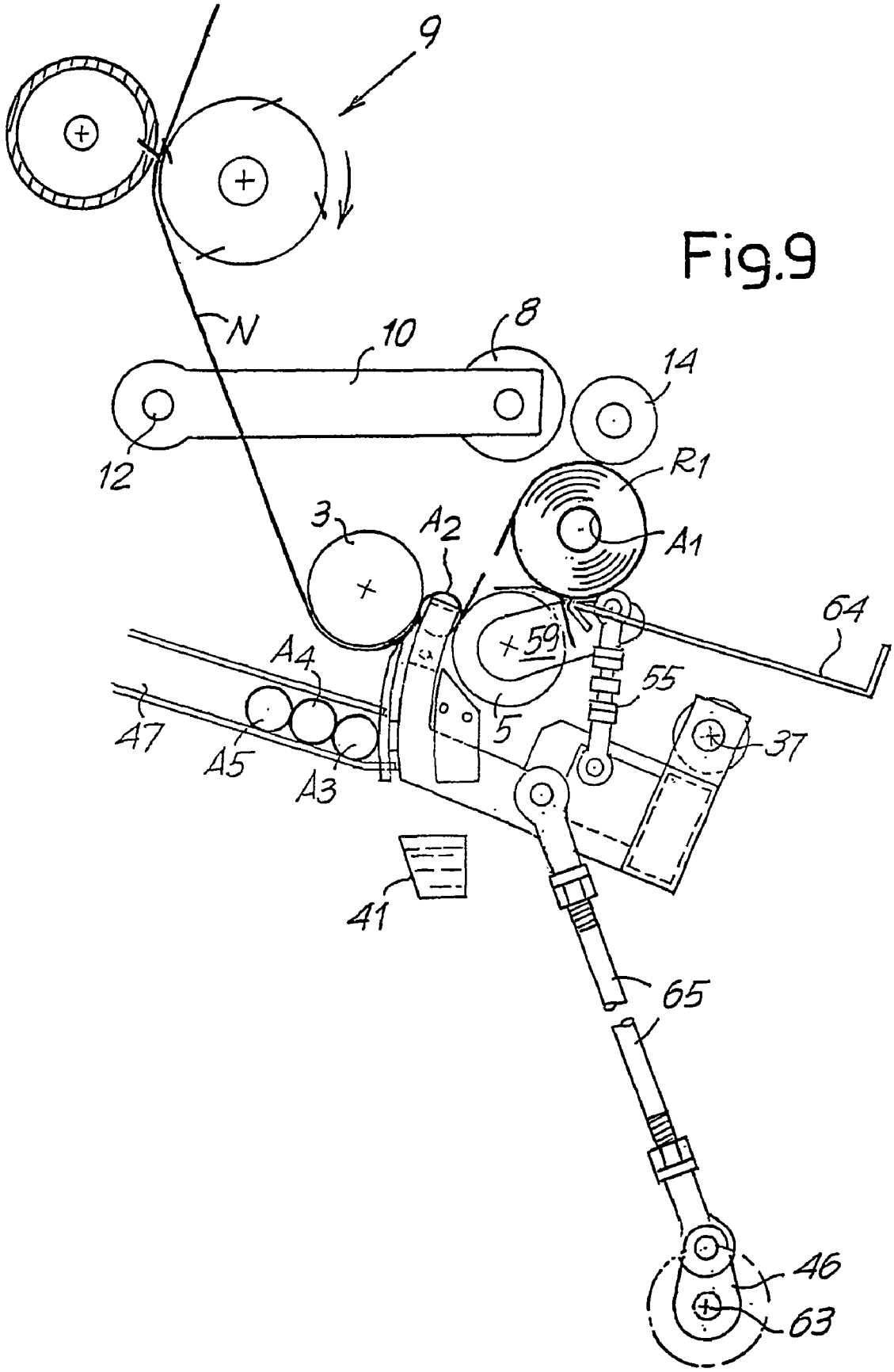
Figure 10:
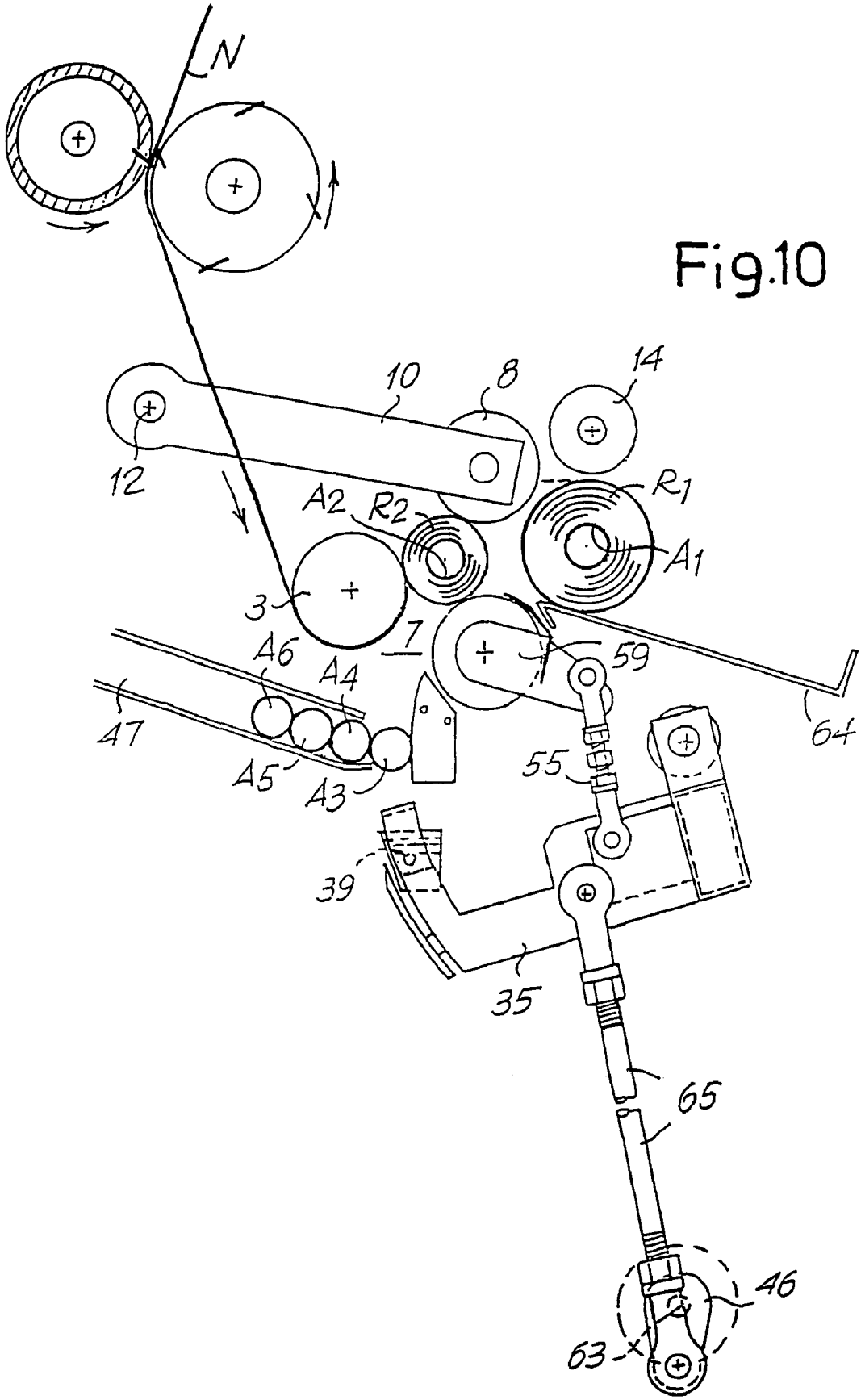
Figure 12:
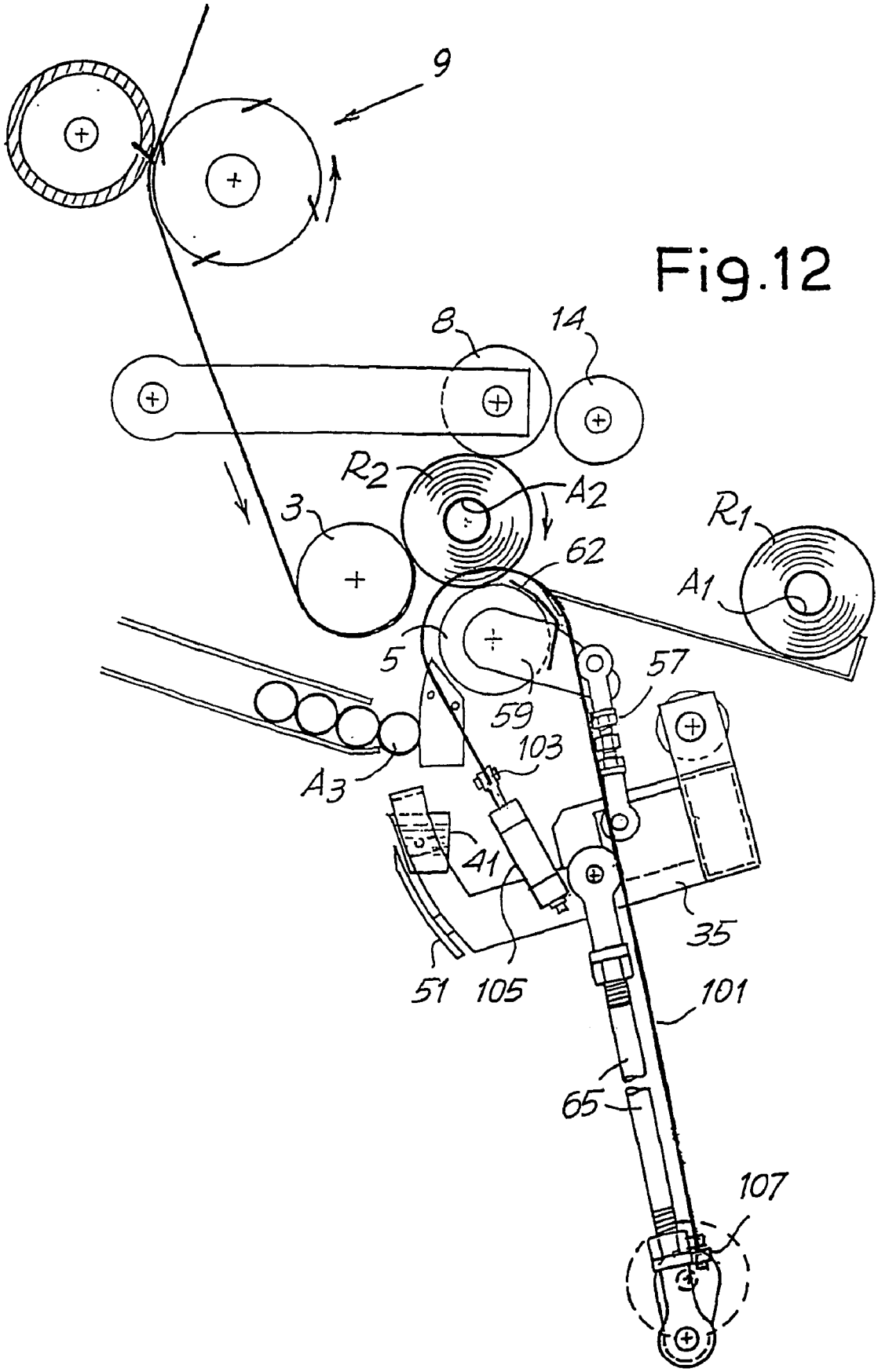

FIGS. 7 and 12 show a modified form of embodiment of the invention, in various successive moments during the winding cycle. Parts that are the same or correspond to those in the previous example of embodiment are indicated by the same reference numerals.

Essentially, the embodiment in FIGS. 7 to 12 differs from the previous one in the greater automation of the machine. The feeder 33 is no longer controlled by a pedal. Rather, in this case, the tie rods 65 each constitute the connecting rod of a crank and con-rod system 65 and 46. The crank 46 turns around an axis 63. The rotation is controlled by a suitable transmission that can possibly take its drive directly from the main motor, or from an independent actuator, which could be an electric motor or even just a hydraulic or pneumatic plunger-cylinder actuator.

In this embodiment, the chute 61 is substituted by a surface 62 shaped-similarly to the left side of the chute 61 in the figures—for inserting itself between the winding cylinder 5 and the finished roll R1. The surface 62 is still integral with a pair of supports 59 hinged and oscillating around the axis 5A of rotation of the winding roller 5, and connected to the oscillating arms 35 of the feeder 33 via tie rods 55. The tie rods 65 thus, in addition to the oscillation of the arms 35, also provoke the oscillation of the supports 59 and the surface 62 that serves for extracting the finished roll from the winding cradle and to unload it onto a slide 64. The operator can pick up the roll from the latter for gluing it, for example, by using a gluing device similar to device 21 and not illustrated. The finished roll could also roll directly onto the gluer, by eliminating the abutment illustrated in the figures at end of the slide 64.

Additional differences with respect to the previous embodiment is the presence on the machine in FIGS. 7 to 12 of a third winding roller 8 carried by a pair of oscillating arms 10 hinged around an oscillation axis 12. The oscillating movement of the arms 10 allows the roller 8 to gradually raise to follow the growing diameter of the roll being formed. The roller 8 can be motorized, using the same motorization that drives the rotation of the winding rollers 3 and 5, or it can be an idle roller. In addition, a cylinder 14, also motorized or idle, with a fixed axis, is positioned next to the third winding roller 8. The position of the cylinder 14 is adjustable so that it can be set at a distance from the position taken by the surface 62 during the unloading of the finished roll, such that the latter makes simultaneous contact with the surface 62 and the cylinder 14.

In the example described herein, contrary to that illustrated in the previous example, the oscillating arms 35 carry a single wire 39, although the possibility of using two or more wires is not excluded.

Operation of the machine in this configuration is clearly illustrated in the series of FIGS. 7 to 12. Rotation of the crank 46 provokes the following operations, in the illustrated sequence. The oscillating arms 35 are raised and they pick up the first core A2 on the waiting queue in the channel 47, taking it to the nip 7 defined between the winding rollers 3 and 5. In this phase, a line of glue is applied to the core by the wire stretched between the two oscillating arms 35 of the feeder. The rising movement of the arms 35 provokes an anticlockwise oscillation of the supports 59 and thus the introduction of the surface 62 between the finished roll R1 and the winding roller 5. The surface 62 with the supports 59 therefore constitutes an extractor member for the finished roll, a member that in the previous example of embodiment was constituted by the supports 59 and the chute 61.

Continuing the rotation of the crank 46 completes the introduction of the core A2 into contact with the winding rollers 3 and 5 in the nip 7, which the core passes through thanks to the peripheral speed differential between the two rollers. The difference in peripheral speed is achieved, for example, with a temporary deceleration of the winding roller 5. The web material N is torn (FIG. 9) as described in the previous example, while the finished roll R1, entering into contact with the surface 62 (which is substantially motionless in this phase) moves away from the winding cradle, losing contact with the winding rollers 3 and 5. In the passage from the position in FIG. 9 to the position in FIG. 10, the crank 46 continues to turn, making the oscillating arms 35 of the feeder 33 drop down again and also making the surface 62 drop. The finished roll has passed beneath the cylinder 14 and now rolls on the slide 64 towards a lower abutment provided at the end of the slide.

The roller 14 serves to slow the movement of the roll in the unloading phase, in this way causing the web material to become slack so that it can wedge between the new core and the second winding roller, for carrying out the tear.

Figure 11:
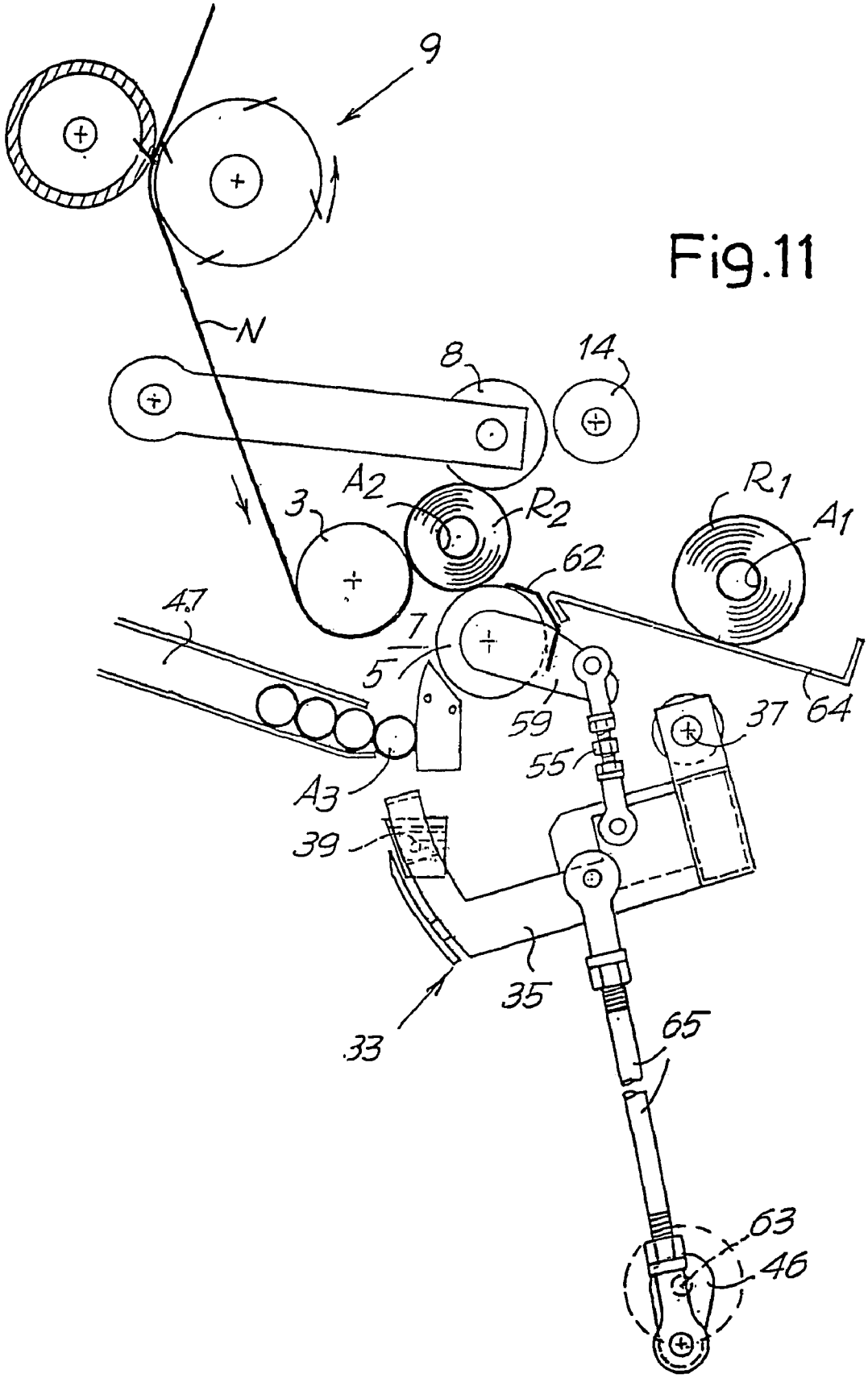

In FIGS. 11 and 12 it can be observed how the oscillating arms 35, and also the surface 62, are kept still, while the finished roll R1 stops at the end of the slide 64 and a new roll R2 is formed around the new winding core A2 in the cradle defined by the winding rollers 3, 5 and 8.

FIG. 12 also shows a band brake, omitted in the previous figures for the sake of clarity of the drawings, which serves to provoke the temporary slowing of the winding roller 5. The band brake includes a band 101, a first end of which is anchored at 103 to an elastic system 105 fixed to the structure (non illustrated) of the machine. The opposite end of the band 101 is fixed at 107 to the crank 46. In this way, the rotation of the crank 46 automatically provokes the tensioning of the band 101 and thus the braking of the winding roller 5 in the phase where the slowing of the roller is required, i.e. in the phase illustrated in FIGS. 8 and 9. In this way, the insertion of the winding core, the unloading of the roll and the slowing of the winding roller 5 is achieved with a single control.

The winding core can remain inside the roll produced by the described machine. Alternatively, and in a known manner, the winding core can be fashioned to permit its extraction from the finished roll. For example, it could be made of plastic to facilitate slipping out and optionally have abutments at one or both ends for performing extraction via a mechanical extractor. The cores extracted from the finished rolls can be manually recycled by the operator.

Figure 13:
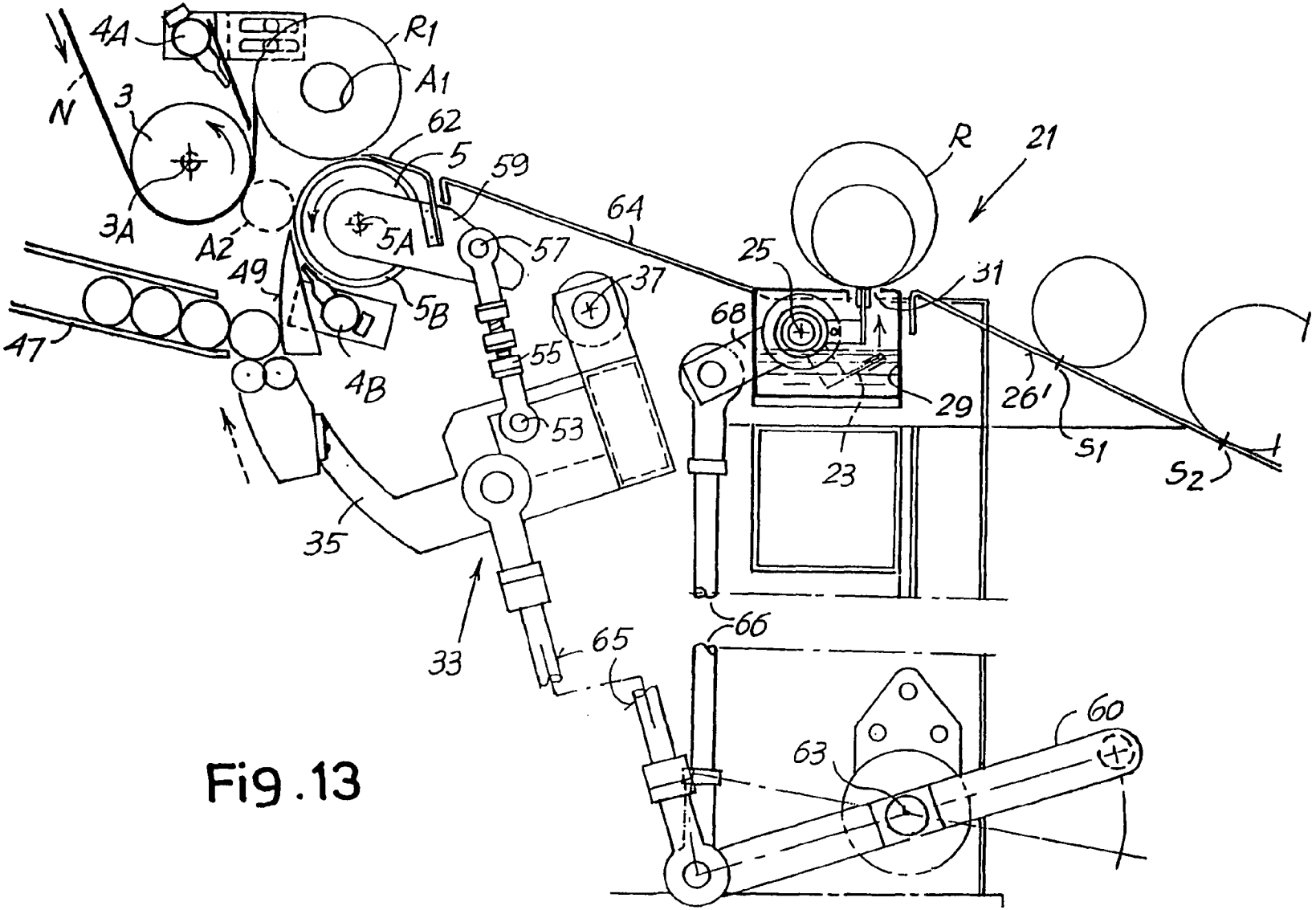

FIG. 13 illustrates a modified embodiment of the invention. Alike numbers indicate the same or equivalent parts to those of the previous examples of embodiment. With respect to the embodiment in FIGS. 7 to 12, the machine in FIG. 13 differs first of all for the absence of a gluing system for the winding cores A. These are picked up via a feeder 33 from a channel 47 and are directly inserted through the nip 7 between the winding rollers 3 and 5. The start of winding is achieved by blasts of air emitted by nozzles 4A and 4B, opportunely oriented with respect to the path of the web material N and that of the winding core A, so as to start winding the first turn of material around the core. Initial winding systems of this type are known from the state of the art and do not require detailed description. As can be seen in the drawing, the nozzles are arranged in two positions, above and below the nip between the rollers 3 and 5, in two rows substantially parallel to the axes of rotation of the tollers.

In addition, in the example in FIG. 13 there is no con-rod and crank system 46 and 65, which is substituted by a pedal 60 similar to that of the embodiment in FIGS. 1 to 6.

In the absence of a glue distributor, the feeder 33 will have a different shape with respect to the previous configuration, as it no longer needs to perform the glue distribution function. It will therefore have a simple profile for the insertion of cores into the winding cradle, or will be equipped (as in the illustrated example) with a double series of staggered wheels defining a cradle for receiving the new core to be introduced into the winding zone. In certain cases, just a single series of support rollers or wheels for the winding core could be provided.

Secondly, to also permit the utilization of winding cores A that are not compressible or deformable, or only deformable with difficulty, in the example shown in FIG. 13 the winding roller 5 has a covering 5B made with a pliable material, such as rubber or similar, of adequate softness. In this way, when the feeder 33 inserts a new core A in the nip 7, the difference between the diameter of the core A and the size of the nip can be compensated by compression of the covering 5B of the winding roller, instead of squeezing the core. This solution, which can also be adopted in one or the other of the two machines illustrated in the previous figures, also permits metal winding cores to be used, in aluminium for example, which do not compress sufficiently for passing through the nip 7. In particular, cores of this type can be used when the winding cycle contemplates the subsequent extraction of the winding core and its recycling. A recyclable core can be used on a winding system without glue, as in the case of FIG. 13, or using glue, a watery glue for example, which can easily be removed from the core or even not leave any residues on the winding core once this has been extracted from the finished roll.

The third aspect that differentiates the machine in FIG. 13 with respect to the machine in FIG. 7 consists in the fact that the same pedal 60, with which the raising of the feeder 33 and the oscillation of the surface 62 is controlled, serves to control the mobile glue distribution element 23 for closure of the end edge of the roll R. For this purpose, in addition to the tie rod 65, a second tie rod 66 is hinged on the pedal 60, the opposite end of said second tie rod being linked to a lever 68 integral with the element 23 and oscillating around the axis 25. As can be observed from comparing FIGS. 7 and 13, the rotation around the axis 25 occurs in the opposite direction in the two cases: in FIG. 7, the mobile element 23 covers itself in glue by immersing itself in the tank 29 with an anticlockwise rotation and inserts itself into the slot or upper opening 31 via a clockwise oscillating movement. In FIG. 13, when the pedal is raised, the element 23 is in the position of maximum oscillation in the anticlockwise direction and is positioned in the slot. To immerse it in the glue contained in the tank 29 it is necessary to press the pedal 60 to provoke a clockwise rotation of the element 23 and thus its immersion.

With this arrangement, when a finished roll R must be unloaded and glued, the operator presses the pedal 60 and provokes the expulsion of the roll and the immersion of the element 23 in the glue. Releasing the pedal, the element 23 positions itself at the correct point for gluing and the operator can proceed with carrying out the gluing operation.

In the configuration shown in FIG. 13, when the pedal 60 is pressed, the roll is unloaded down the slide 26' to a position from where it is taken by the operator, without receiving glue, because the pedal 60 is pressed and the distributor is therefore down. Along the slide 26' markings S1 and S2 of a scale are provided, that permits the operator to position the roll with the unglued free edge on the marker point and make it roll upwards along the slide 26' until it reaches the contact position defined by the upper end wall of the tank 29, where the glue distribution slot 31 is located. The markings S1 and S2 correspond to various roll diameters and are set so that when a roll is rolled upwards from a marker with the same corresponding diameter, the amount of web material that is unwound corresponds exactly to that required for applying the glue in the correct position on the cylindrical surface of the roll that—being made to roll by the operator—reaches the gluing position.

The possibility of also using a dual tie rod in a similar configuration to that of FIGS. 7 to 12 is not excluded, with a motorized shaft controlling the movement of the tie rod operating the feeder and the tie rod operating the roll gluer.

The various new characteristics described with reference to the various examples of embodiment can be combined with each other in various ways. Any combination or subcombination of characteristics that is new and inventive constitutes the specific subject of this invention.

In particular, according to a further aspect, the subject of the present invention is a continuous surface rewinder machine for the production of rolls of web material wound around winding cores. By continuous, surface rewinder machine a rewinder is understood, where the rolls are formed by keeping them into rotation through contact with peripherally arranged winding rollers, and wherein the web material to be wound is fed continuously, without interruption between completion of one roll and starting the winding of the subsequent roll. According to this aspect of the invention, the rewinder machine comprises only two winding rollers forming a winding cradle, on which rolls of web material are sequentially formed. Conversely usually known continuous surface rewinders are provided with a cluster of three rollers forming a winding cradle, one of said roller at least being movable to allow roll diameter increase.

According to this further aspect, the invention also relates to a method for subsequently forming rolls of web material wound around winding cores, including the steps of:

providing a first winding roller and a second winding roller forming a winding cradle;

continuously feeding said web material to said winding cradle to form a roll-in said cradle, said roll being formed by contacting it with only said two winding rollers;

upon completion of said roll, discharging said roll from said cradle, inserting a new core in said cradle and severing said web material, without interrupting feeding of said web material.

It is understood that the drawings only illustrate practical forms of embodiment of the invention, which can vary in form and arrangement without leaving the scope of the concept at the base of the invention. The only purpose of the presence of any reference numerals in the attached claims is that of facilitating the reading of the claims in relation to the foregoing description and the enclosed drawings, and does not limit the scope of protection in any way.

The invention claimed is:

1. A rewinder machine for producing rolls of web material wound around winding cores, comprising:

a first winding roller, a second winding roller, defining with said first winding roller a winding cradle, a feeder for sequentially introducing winding cores to said winding cradle, a first gluer for applying glue on said cores, wherein said feeder includes at least one element for applying said glue to the winding cores during their introduction to said winding cradle, said element including at least one elongated member that can be immersed in a container of glue arranged beneath a zone for picking up the winding cores, said elongated member covering itself in glue in said container and transferring said glue by contact to each core sequentially picked by said feeder.

2. A rewinder machine according to claim 1, wherein said feeder has two elongated members.

3. A rewinder machine according to claims 1 or 2, wherein said feeder includes two mobile arms between which said at least one elongated member is supported.

4. A rewinder machine according to claim 3, wherein said elongated member comprises a wire or a cable stretched between the two mobile arms.

5. A rewinder machine according to claim 1, wherein said feeder oscillates around an axis substantially parallel to axes of the first winding roller and the second winding roller.

6. A rewinder machine according to claim 1, further comprising an extractor member, for extracting a roll formed in said winding cradle, said extractor member being mechanically linked to said feeder.

7. A rewinder machine according to claim 6, wherein said extractor member oscillates around an axis parallel to an axis of at least one of said first winding roller or said second winding roller.

8. A rewinder machine according to claim 7, wherein said extractor member is constrained around the axis of rotation of said second winding roller.

9. A rewinder machine according to claim 6, wherein said extractor member has a pick up surface for rolls to be unloaded from said winding cradle.

10. A rewinder machine according to claim 9, wherein said extractor member includes a pair of oscillating arms articulated around an axis of rotation of the second winding roller, to which said pick up surface is rigidly constrained, and said oscillating arms are linked to said feeder via tie rods hinged to said arms and to said feeder.

11. A rewinder machine according to claim 9 or 10, wherein said pick up surface forms a chute for said rolls.

12. A rewinder machine according to claim 9 or 10, wherein said pick up surface forms a rolling surface for said rolls.

13. A rewinder machine according to claim 9 or 10, wherein said pick up surface is shaped to insert itself between the roll and the second winding roller, being substantially tangential to said second winding roller.

14. A rewinder machine according to claim 1, wherein said feeder is manually controlled.

15. A rewinder machine according to claim 1, wherein said feeder is controlled by a main motor that also controls rotation of said first winding roller and of said second winding roller.

16. A rewinder machine according to claim 1, wherein said feeder is controlled by an independent actuator.

17. A rewinder machine according to claim 1, further comprising a perforator for perforating the web material along transversal perforation lines, and said perforator, said first winding roller and said second winding roller being controlled by a common motor.

18. A rewinder machine according to claim 1, wherein said first winding roller and said second winding roller are controlled to assume, during at least part of a winding cycle of a roll, mutually different peripheral speeds to facilitate introduction of the winding core through a nip defined between said first winding roller and said second winding roller.

19. A rewinder machine according to claim 18, wherein change in the peripheral speeds of said first winding roller and the second winding roller with respect to each other is manually controlled.

20. A rewinder machine according to claim 18, further comprising a brake for braking the second winding roller, temporarily changing peripheral speed of the second winding roller with respect to a peripheral speed of the first winding roller.

21. A rewinder machine according to claim 20, wherein said brake is manually operated via a control that also operates said feeder.

22. A rewinder machine according to claim 1, further comprising a feed channel for the winding cores, said feeder being equipped with a retaining surface that holds the cores in said feed channel.

23. A rewinder machine according to claim 1, further comprising a third winding roller with a moveable axis.

24. A rewinder machine according to claim 1, wherein a second gluer is arranged downstream of said first winding roller and said second winding roller for gluing a free end edge of the roll.

25. A rewinder machine according to claim 24, wherein said second gluer is manually controlled.

26. A rewinder machine according to claim 24, wherein said second gluer has a support surface for the roll to be glued, with an opening defining a position of equilibrium for said roll, and with a mobile element for distributing the glue arranged beneath said opening.

27. A rewinder machine according to claim 26, wherein said mobile element is operated by a manual control.

28. A machine according to claim 24, further comprising a pair of tie rods, controlled by a drive shaft also controlling movement of the feeder and movement of said second gluer.

29. A machine according to claim 28, wherein said pair of tie rods are controlled by a pedal.

30. A machine according to claim 1, wherein one of said first winding roller or said second winding roller has a pliable cylindrical surface.

31. A method for producing rolls of web material wound around winding cores comprising completing winding of a first roll around a winding core in a winding cradle, upon termination of winding said first roll, inserting a new winding core via a feeder to said winding cradle and unloading the first roll from the winding cradle, with glue being applied to said new winding core, wherein said glue is applied on said new winding core via said feeder, which is immersed at least partially in a container of glue and lifted from the container to the new winding core, said feeder pushing said winding core into a nip defined between a first winding roller and a second winding roller.

32. A method according to claim 31, further comprising extracting the winding core from the first roll upon completion of winding and recycling the winding core for a subsequent winding cycle.

33. A rewinder machine for producing rolls of web material wound around winding cores, comprising:

a first winding roller, a second winding roller, defining with said first winding roller a winding cradle, a feeder for sequentially introducing winding cores to said winding cradle, wherein an extractor member, for extracting a roll formed in said winding cradle, is mechanically linked to said feeder;

wherein said extractor member oscillates around an axis parallel to an axis of at least one of said first winding roller or said second roller; and wherein said extractor member is constrained around the axis of said second winding roller.

34. A rewinder machine for producing rolls of web material wound around winding cores, comprising:

a first winding roller, a second winding roller, defining with said first winding roller a winding cradle, a feeder f or sequentially introducing winding cores to said winding cradle, wherein an extractor member, for extracting a roll formed in said winding cradle, is mechanically linked to said feeder;

wherein said extractor member has a pick up surface for rolls to be unloaded from said winding cradle; wherein said extractor member includes a pair of oscillating arms articulated around the axis of the second winding roller, to which said pick up surface is rigidly connected, and wherein said oscillating arms are linked to said feeder via tie rods hinged to said arms and to said feeder.

35. A rewinder machine according to claim 34, wherein said pick up surface forms a picking cradle for said rolls.

36. A rewinder machine according to claim 34, wherein said pick up surface forms a rolling surface for said rolls.

37. A rewinder machine for producing rolls of web material wound around winding cores, comprising:

a first winding roller, a second winding roller, defining with said first winding roller a winding cradle, a feeder for sequentially introducing winding cores to said winding cradle, and a pair of tie rods, controlled by a drive shaft which also controls movement of the feeder and movement of a gluer; wherein an extractor member, for extracting a roll formed in said winding cradle, is mechanically linked to said feeder.

38. A machine according to claim 37, wherein said pair of tie rods are controlled by a pedal.

* * * * *